US008015955B2

(12) United States Patent
Maezuru et al.

(10) Patent No.: US 8,015,955 B2
(45) Date of Patent: Sep. 13, 2011

(54) VARIABLE STROKE

(75) Inventors: Akinori Maezuru, Wako (JP); Shigekazu Tanaka, Wako (JP); Taichi Yoshikawa, Wako (JP)

(73) Assignee: Honda Motor Co., Ltd., Tokyo (JP)

( * ) Notice: Subject to any disclaimer, the term of this patent is extended or adjusted under 35 U.S.C. 154(b) by 154 days.

(21) Appl. No.: 12/439,779

(22) PCT Filed: Sep. 4, 2007

(86) PCT No.: PCT/JP2007/067219

§ 371 (c)(1),
(2), (4) Date: Mar. 3, 2009

(87) PCT Pub. No.: WO2008/032608

PCT Pub. Date: Mar. 20, 2008

(65) Prior Publication Data

US 2010/0186721 A1 Jul. 29, 2010

(30) Foreign Application Priority Data

Sep. 12, 2006 (JP) ..... 2006-247264
Sep. 25, 2006 (JP) ..... 2006-259578

(51) Int. Cl.
*F02B 75/04* (2006.01)
*F02D 15/02* (2006.01)

(52) U.S. Cl. ..... 123/48 B

(58) Field of Classification Search ..... 123/48 B, 123/78 E, 48 D, 54.1, 78 BA, 305, 348, 197.5, 123/78 F; 701/103, 114, 101; 92/13.7, 13.3; 29/527.5; *F02B 75/04; F02D 15/02*
See application file for complete search history.

(56) References Cited

U.S. PATENT DOCUMENTS 6,691,655 B2 * 2/2004 Aoyama et al. ..... 123/90.16
(Continued)

FOREIGN PATENT DOCUMENTS

EP 1593822 A1 11/2005
(Continued)

OTHER PUBLICATIONS

International Search Report for Application No. PCT/JP2007/067219, dated Dec. 25, 2007.

(Continued)

*Primary Examiner* — Michael Cuff
*Assistant Examiner* — Keith Coleman
(74) *Attorney, Agent, or Firm* — Nelson Mullins Riley & Scarborough LLP; Anthony A. Laurentano

(57) ABSTRACT

A variable stroke characteristic engine is provided in which a piston (11) and a crankshaft (30) are linked to a control shaft (65) via a variable stroke link mechanism (LV), and the variable stroke link mechanism (LV) is operated by an actuator (AC) that drives the control shaft (65) to thus make the stroke travel of the piston (11) variable, wherein a housing (HU) of the hydraulic actuator (AC) for operating the variable stroke link mechanism (LV) is provided in a bearing member (54) of a lower block (41) supporting the crankshaft (30), and the housing (HU) is thus made small, thereby suppressing any increase in the dimensions of the engine. Furthermore, a hydraulic switching valve unit (92) for controlling operation of the hydraulic actuator (AC) is directly mounted on the housing (HU), thereby enhancing the responsiveness of the hydraulic actuator (AC).

13 Claims, 11 Drawing Sheets

U.S. PATENT DOCUMENTS

| | | | | |
|---|---|---|---|---|
| 7,059,280 | B2 * | 6/2006 | Nohara et al. | 123/48 D |
| 7,234,424 | B2 * | 6/2007 | Tanaka et al. | 123/48 B |

FOREIGN PATENT DOCUMENTS

| | | | |
|---|---|---|---|
| EP | 1659276 | A2 | 5/2006 |
| EP | 1674693 | A2 | 6/2006 |
| EP | 2022958 | A2 | 2/2009 |
| JP | 9-228858 | | 9/1997 |
| JP | 2002-317663 | | 10/2002 |
| JP | 2003-322036 | | 11/2003 |
| JP | 2005-30233 | | 2/2005 |
| JP | 2006-161651 | | 6/2006 |
| JP | 2006-177192 | | 7/2006 |

OTHER PUBLICATIONS

Supplementary European Search Report for Application No. EP07806674, dated Jul. 17, 2009.

Japanese Office Action for Application No. 2006-247264, dated Oct. 20, 2010.

* cited by examiner

HIGH COMPRESSION RATIO STATE

FIRST POSITION

LOW COMPRESSION RATIO STATE

SECOND POSITION

VARIABLE STROKE

RELATED APPLICATIONS

This application is a 35 U.S.C. 371 national stage filing of International Application No. PCT/JP2007/067219, filed Sep. 4, 2007, which claims priority to Japanese Patent Application No. 2006-247264 filed on Sep. 12, 2006 and Japanese Patent Application No. 2006-259578 filed Sep. 25, 2006 in Japan. The contents of the aforementioned applications are hereby incorporated by reference.

TECHNICAL FIELD

The present invention relates to an improvement of a variable stroke characteristic engine in which a piston and a crankshaft are linked to a control shaft via a variable stroke link mechanism, and the variable stroke link mechanism is operated by an actuator that drives the control shaft to thus make the stroke travel of the piston variable.

BACKGROUND ART

Conventionally, there is a known variable stroke characteristic engine that includes a variable stroke link mechanism formed from an upper link having one end linked to a piston pin of a piston, a lower link linked to the other end of the upper link and linked to a crankpin of a crankshaft, and a control link having one end linked to the lower link and the other end swingably linked to an engine main body, in which the stroke travel of the piston is made variable by driving the control link by an actuator (ref. Patent Publications 1 and 2).

Patent Publication 1: Japanese Patent Application Laid-open No. 2006-177192

Patent Publication 2: Japanese Patent Application Laid-open No. 9-228858

DISCLOSURE OF INVENTION

Problems to be Solved by the Invention

In such an engine, when the actuator for driving the variable stroke link mechanism is provided outside a crankcase, which is an engine main body, the actuator protrudes outside the engine main body by a large amount; not only does the overall volume of the engine including other accessories increase, but there is also a possibility that the actuator will interfere with the other accessories, and the degree of freedom in positioning the actuator therefore decreases. In particular, when this engine is used for a vehicle there is the problem that this tendency becomes yet more marked.

In order to solve such a problem, if the actuator is provided within, for example, a crank chamber of the engine main body, the crankcase protrudes outward by a large amount, thus resulting in larger dimensions of the engine main body and an increase in cost.

When such an engine actuator is of a hydraulic type, it is arranged so that the actuator is hydraulically operated by controlling the supply of hydraulic oil from a hydraulic supply system equipped with a hydraulic pump to a hydraulic chamber of the actuator via a switching valve, but since a hydraulic switching valve unit housing the switching valve is formed separately from the actuator, and the two are connected via piping, there are the problems that the responsiveness of the hydraulic actuator is degraded due to an increase in length of the oil path and the cost increases due to an increase in the number of components required for countermeasures against oil leakage.

The present invention has been accomplished in the light of such circumstances, and it is an object thereof to provide a novel variable stroke characteristic engine in which the above-mentioned problems have been solved by greatly reducing the dimensions of a housing forming a main portion of an actuator of the above type and in which, when the hydraulic actuator is of a hydraulic type, the support rigidity is improved and the influence of heat thereon is suppressed and, further more, the responsiveness of the hydraulic actuator is improved.

Means for Solving the Problems

In order to attain the above object, according to a first aspect of the present invention, there is provided a variable stroke characteristic engine in which a piston and a crankshaft are linked to a control shaft via a variable stroke link mechanism, and the variable stroke link mechanism is operated by an actuator that drives the control shaft to thus make the stroke travel of the piston variable, characterized in that at least part of a housing of the actuator is formed as part of an engine main body.

The engine main body includes a cylinder block having a cylinder slidably provided with a piston, a crankcase (upper block and lower block) integrally joined to the cylinder block and rotatably supporting a crankshaft, and a bearing member integrally joined to the crankcase.

In order to attain the above object, according to a second aspect of the present invention, in addition to the first aspect, the part of the engine main body forming at least part of the housing of the actuator is a bearing member that is fixed to the engine main body and rotatably supports the crankshaft.

In order to attain the above object, according to a third aspect of the present invention, in addition to the second aspect, the bearing member is a bearing cap that is fixed to a cylinder block forming the engine main body and rotatably supports the crankshaft.

In order to attain the above object, according to a fourth aspect of the present invention, in addition to the second or third aspect, at least part of the housing of the actuator is cast on the bearing member.

In order to attain the above object, according to a fifth aspect of the present invention, in addition to the second, third or fourth aspect, among a plurality of bearing members supporting the crankshaft, the housing of the actuator is provided in a bearing member while avoiding bearing members at opposite ends.

In order to attain the above object, according to a sixth aspect of the present invention, in addition to the fifth aspect, the housing of the actuator is provided in a center bearing member of the engine main body of an in-line four cylinder engine.

In order to attain the above object, according to a seventh aspect of the present invention, in addition to the first, second, third, fourth, fifth or sixth aspect, the housing of the actuator is formed separately from a lower block fixed to an upper block of the cylinder block.

In order to attain the above object, according to an eighth aspect of the present invention, in addition to the first aspect, the actuator is a hydraulic actuator, and a hydraulic switching valve unit for controlling the supply of hydraulic oil thereto is mounted on the housing of the hydraulic actuator.

In order to attain the above object, according to a ninth aspect of the present invention, in addition to the eighth aspect, the hydraulic switching valve unit is clamped together with a cylinder block of the engine main body and bearing means fixed to the cylinder block so as to support the crankshaft.

In order to attain the above object, according to a tenth aspect of the present invention, in addition to the eighth or ninth aspect, a width, in the control shaft direction, of a mounting face, for the hydraulic switching valve unit, of the housing of the hydraulic actuator is formed so as to be wider than a width of the housing in the control shaft direction.

In order to attain the above object, according to an eleventh aspect of the present invention, in addition to the eighth, ninth or tenth aspect, the width of the housing of the hydraulic actuator in the control shaft direction is formed so as to be narrower than a width of the hydraulic switching valve unit in the control shaft direction, and is contained within the width.

In order to attain the above object, according to a twelfth aspect of the present invention, in addition to the eighth, ninth, tenth or eleventh aspect, the hydraulic switching valve unit is provided on the engine main body on a side to which an intake system is connected.

In order to attain the above object, according to a thirteenth aspect of the present invention, in addition to the eighth, ninth, tenth, eleventh or twelfth aspect, the hydraulic switching valve unit is disposed within a plane of projection of an opening of a radiator fan when viewed from the front side of a vehicle.

In order to attain the above object, according to a fourteenth aspect of the present invention, in addition to the eighth, ninth, tenth, eleventh, twelfth or thirteenth aspect, the housing of the hydraulic actuator is disposed within a crankcase, and the hydraulic switching valve unit is mounted on a portion of the housing of the hydraulic actuator that is exposed outside the engine main body.

Effects of the Invention

In accordance with the first aspect of the present invention, since at least part of the housing of the actuator for operating the variable stroke link mechanism is formed as part of the engine main body, it is possible to reduce the dimensions of the housing and decrease the number of components, thereby suppressing any increase in the dimensions of the engine in spite of it being a variable stroke characteristic type.

In accordance with the second aspect of the present invention, since part of the engine main body forming the housing of the actuator is a bearing member for rotatably supporting the crankshaft, the actuator can be placed in proximity to the crank shaft, thus reducing the dimensions of the engine still further.

In accordance with the third aspect of the present invention, since the bearing member provided with the housing is a bearing cap rotatably supporting the crankshaft, it is easy to improve the rigidity with which the crankshaft is supported and to mold the housing.

In accordance with the fourth aspect of the present invention, since the housing is cast on the bearing member, it is possible to further enhance the rigidity of the housing.

In accordance with the fifth aspect of the present invention, since, among the plurality of bearing members, the housing is provided in the bearing member other than bearing members on opposite ends, this contributes to reducing the dimensions of the engine still further.

In accordance with the sixth aspect of the present invention, since the housing is provided in the center bearing member of the engine main body of the in-line four cylinder engine, it is possible to contribute to still further improving the rigidity of the center bearing member, on which the largest load is imposed.

In accordance with the seventh aspect of the present invention, since the housing is formed separately from the lower block, which is fixed to the upper block, this gives a degree of freedom in selecting the material for the housing, the degree of freedom in machining it as a single component increases, and the assembly thereof onto the lower block can be carried out compactly and easily.

In accordance with the eighth aspect of the present invention, since the hydraulic switching valve unit for controlling the supply of hydraulic oil to the hydraulic actuator is mounted on the housing of the hydraulic actuator, the hydraulic switching valve unit can be connected to the hydraulic actuator in close proximity without requiring piping, thus improving the responsiveness of the hydraulic actuator.

In accordance with the ninth aspect of the present invention, since the hydraulic switching valve unit is clamped together with the cylinder block of the engine main body and the bearing means, it is possible to improve the rigidity with which the valve unit is secured and reduce the number of components.

In accordance with the tenth aspect of the present invention, since the width, in the control shaft direction, of the mounting face, for the hydraulic switching valve unit, of the housing of the hydraulic actuator is wider than the width in the control shaft direction of the housing, it is possible to guarantee the rigidity of the mounting face of the housing without increasing the overall dimensions of the housing.

In accordance with the eleventh aspect of the present invention, since the width, in the control shaft direction, of the housing of the hydraulic actuator is narrower than and is contained within the width in the control shaft direction of the hydraulic switching valve unit, it is possible to make the housing compact while improving the rigidity with which the hydraulic switching valve unit is supported.

In accordance with the twelfth aspect of the present invention, since the hydraulic switching valve unit is provided on the engine main body on the side to which the intake system is connected, it is possible to suppress the influence of heat from a heat source, particularly an exhaust system.

In accordance with the thirteenth aspect of the present invention, since the hydraulic switching valve unit receives wind flow and air flow from the radiator fan, any increase in the temperature thereof can be suppressed.

In accordance with the fourteenth aspect of the present invention, since the hydraulic switching valve unit can be mounted on the housing of the hydraulic actuator from the exterior of the engine main body, the ease of mounting is greatly improved.

EXPLANATION OF REFERENCE NUMERALS AND SYMBOLS

Figure 1:
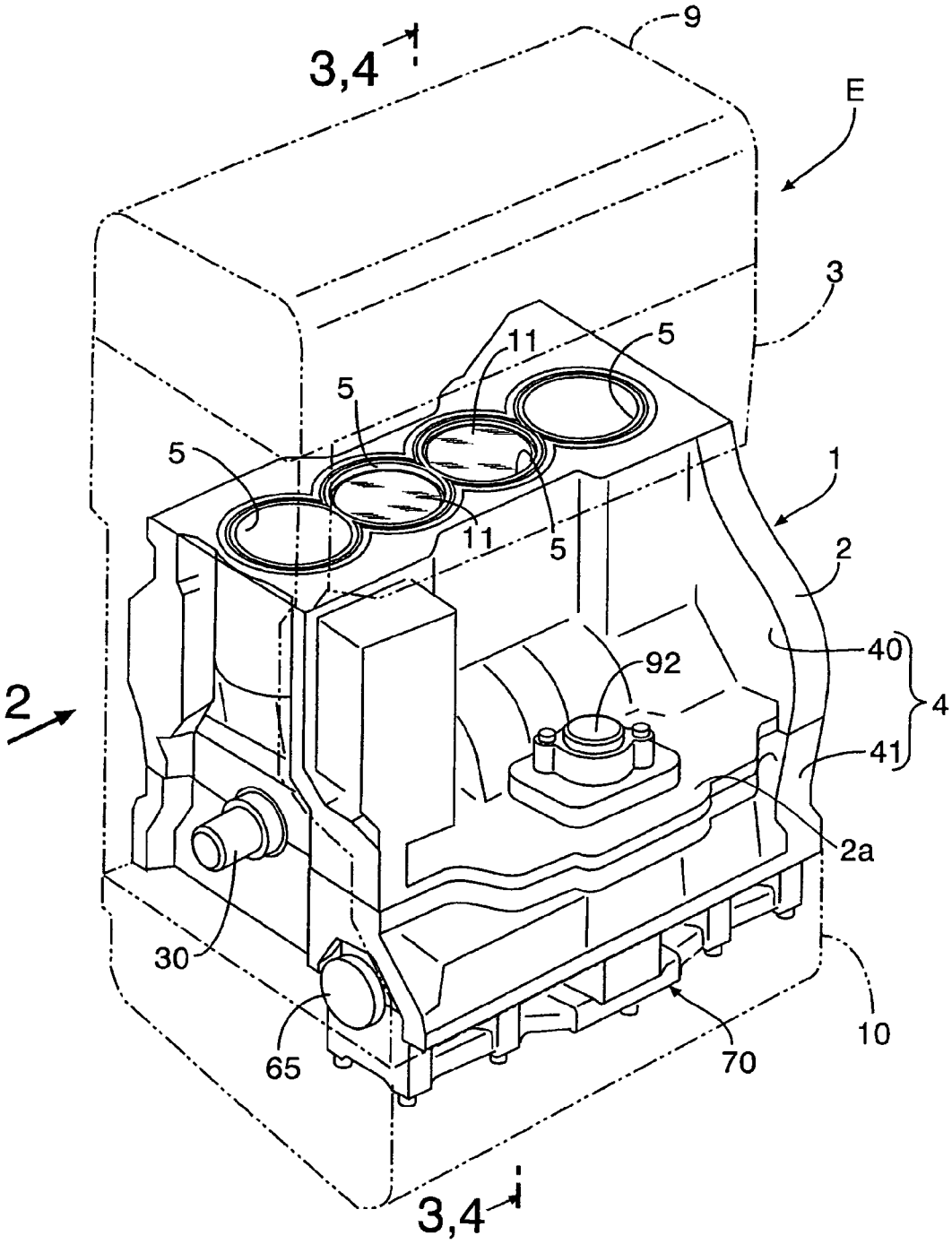
FIG. 1 is an overall schematic perspective view of a variable stroke characteristic engine (first embodiment).

1 Engine main body
2 Cylinder block
11 Piston
30 Crankshaft
40 Upper block
41 Bearing means (lower block)
50 Bearing member (end section bearing member)
51 Bearing member (end section bearing member)
52 Bearing member (middle bearing member)
53 Bearing member (middle bearing member)
54 Bearing member (center bearing member)
65 Control shaft
71 Linking member
90 Mounting face
92 Hydraulic switching valve unit
AC Actuator (hydraulic actuator)
LV Variable stroke link mechanism
HU Housing
D1 Width, in control shaft 65 direction, of hydraulic switching valve unit 92
D2 Width, in control shaft 65 direction, of housing HU
d1 Width, in control shaft 65 direction, of mounting face 90 of housing HU
IN Intake system
RF Radiator fan

BEST MODE FOR CARRYING OUT THE INVENTION

A mode for carrying out the present invention is specifically explained below by reference to an embodiment of the present invention shown in the attached drawings.

Embodiment 1

Figure 2:
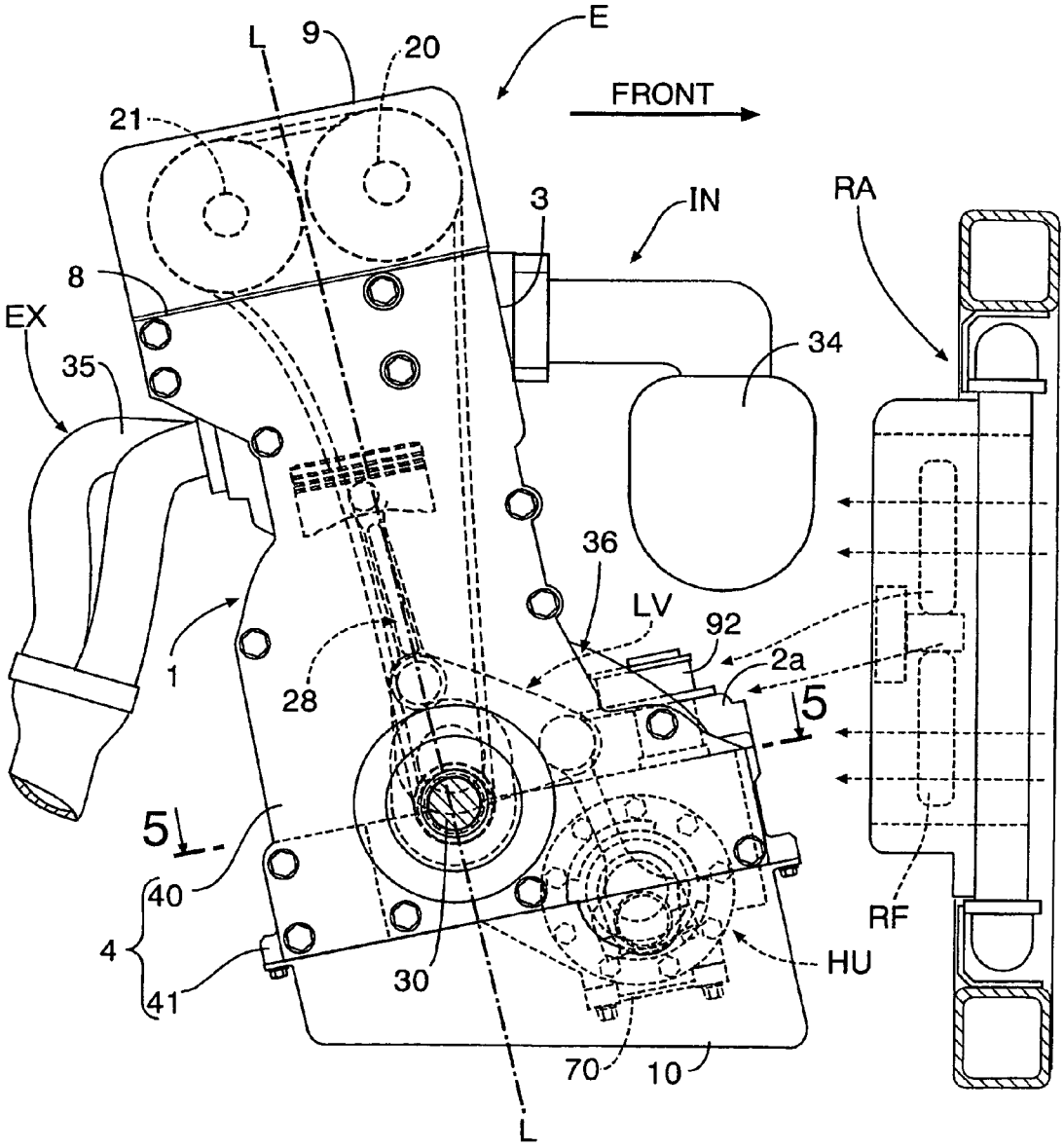
FIG. 2 is a view from arrow 2 in FIG. 1 (first embodiment).

In FIGS. 1 to 4, a variable stroke characteristic engine E related to the present invention is for automobile use and is transversely mounted within an engine compartment of an automobile, which is not illustrated (a crankshaft 30 of the engine is disposed transversely relative to the direction of travel of the automobile). When this engine E is mounted on an automobile, as shown in FIG. 2, it is in a slightly rearwardly tilted state, that is, in a state in which a cylinder axis L-L is inclined slightly rearward relative to a vertical line.

Furthermore, this variable stroke characteristic engine E is an in-line four-cylinder OHC type four-cycle engine; an engine main body 1 thereof includes a cylinder block 2 in which four cylinders 5 are provided in parallel in the transverse direction, a cylinder head 3 integrally joined to the top of a deck surface of the cylinder block 2 via a gasket 6, an upper block 40 (upper crankcase) integrally formed on a lower part of the cylinder block 2, and a lower block 41 (lower crankcase) integrally joined to a lower face of the upper block 40, the upper block 40 and the lower block 41 forming a crankcase 4. A head cover 9 integrally covers an upper face of the cylinder head 3 via a seal 8, and an oil pan 10 is integrally joined to a lower face of the lower block 41 (lower crankcase).

A piston 11 is slidably fitted into each of the four cylinders 5 of the cylinder block 2, four combustion chambers 12, and intake ports 14 and exhaust ports 15 communicating with these combustion chambers 12 are formed in a lower face of the cylinder head 3 that faces the top faces of these pistons 11, and an intake valve 16 and an exhaust valve 17 are provided in the intake port 14 and the exhaust port 15 respectively so as to open and close them. Furthermore, a valve operating mechanism 18 for opening and closing the intake valve 16 and the exhaust valve 17 is provided on the cylinder head 3. This valve operating mechanism 18 includes an intake side camshaft 20 and an exhaust side camshaft 21 rotatably supported on the cylinder head 3, and intake side and exhaust side rocker arms 24 and 25 that are axially and swingably supported on intake side and exhaust side rocker shafts 22 and 23 provided on the cylinder head 3 and that provide a connection between the intake side and exhaust side camshafts 20 and 21 and the intake valve 16 and exhaust valve 17, and in response to rotation of the intake side and exhaust side camshafts 20 and 21 the intake side and exhaust side rocker arms 24 and 25 swing against valve-closing forces of valve springs 26 and 27, thus opening and closing the intake valve 16 and the exhaust valve 17 with a predetermined timing.

As shown in FIG. 2, the intake side and exhaust side camshafts 20 and 21 are operable in association with a crankshaft 30, which will be described later, via a conventionally known timing transmission mechanism 28, and in response to rotation of the crankshaft 30 they are driven at a rotational speed of ½ of the rotation. The valve operating mechanism 18 is covered by the head cover 9 fixed to the cylinder head 3. Moreover, the cylinder head 3 is provided with cylindrical plug insertion tubes 31 corresponding to the four cylinders, and a spark plug 32 is inserted into the plug insertion tube 31.

The plurality of intake ports 14 corresponding to the four cylinders 5 open on a front face of the engine main body 1, that is, toward the front side of a vehicle, and an intake manifold 34 of an intake system IN is connected thereto. Since this intake system IN has a conventionally known structure, detailed explanation thereof is omitted.

Furthermore, the plurality of exhaust ports 15 corresponding to the four cylinders 5 open on a rear face of the engine main body 1, that is, toward the rear side of the vehicle, and an exhaust manifold 35 of an exhaust system EX is connected thereto. Since this exhaust system EX has a conventionally known structure, detailed explanation thereof is omitted.

Furthermore, as shown in FIG. 2, a radiator RA for water cooling the engine main body 1 is disposed on the front side of the engine main body 1, that is, in front of the side where the intake system IN is connected, and a hydraulic switching valve unit 92, which is described later, is disposed within a plane of projection of the opening of the radiator fan RF when viewed from the front of the radiator RA so that the hydraulic switching valve unit 92 is cooled by air flow from the radiator fan RF.

Figure 3:
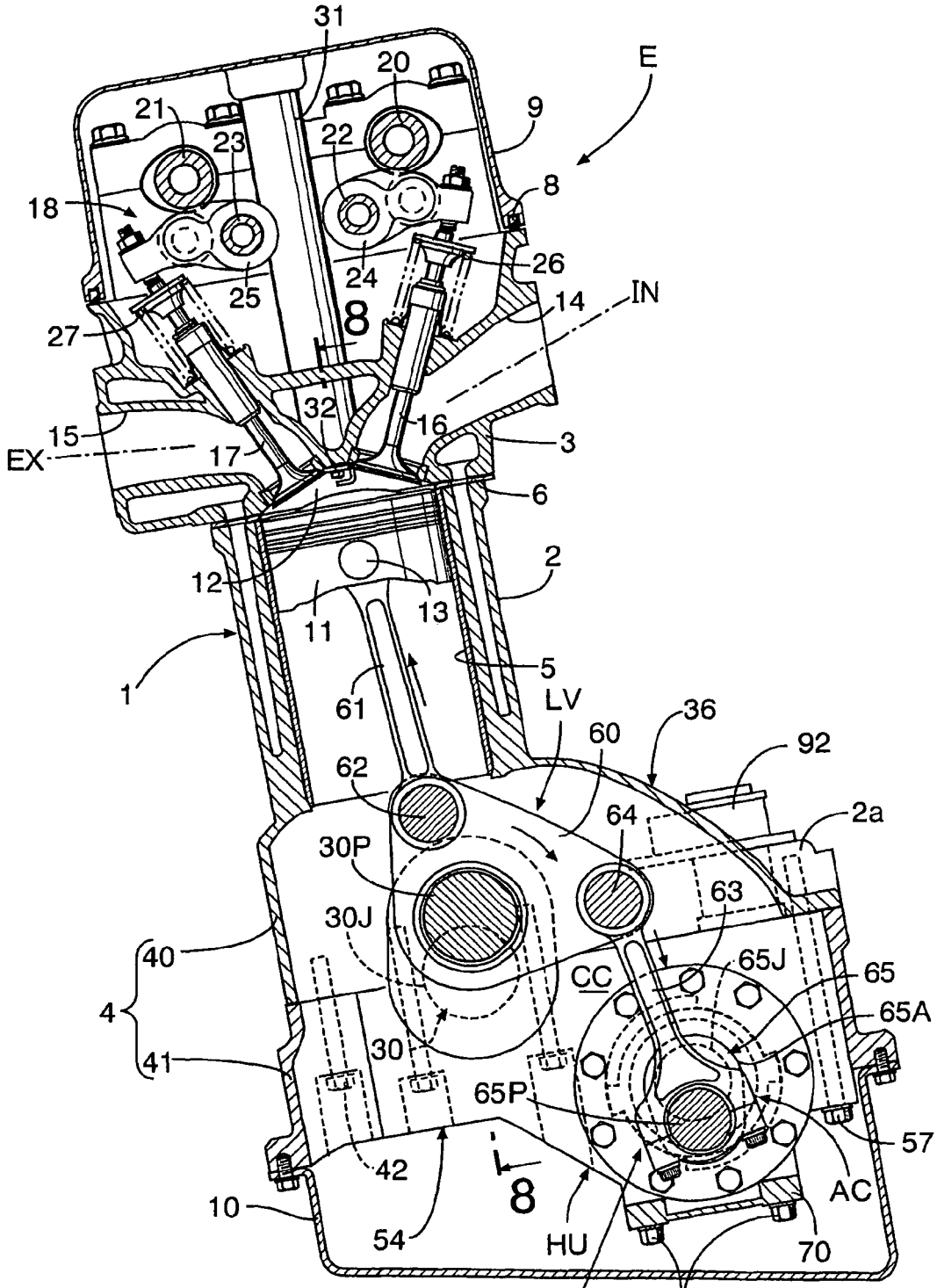
FIG. 3 is a sectional view along line 3-3 in FIG. 1 (high compression ratio state) (first embodiment).
Figure 4:
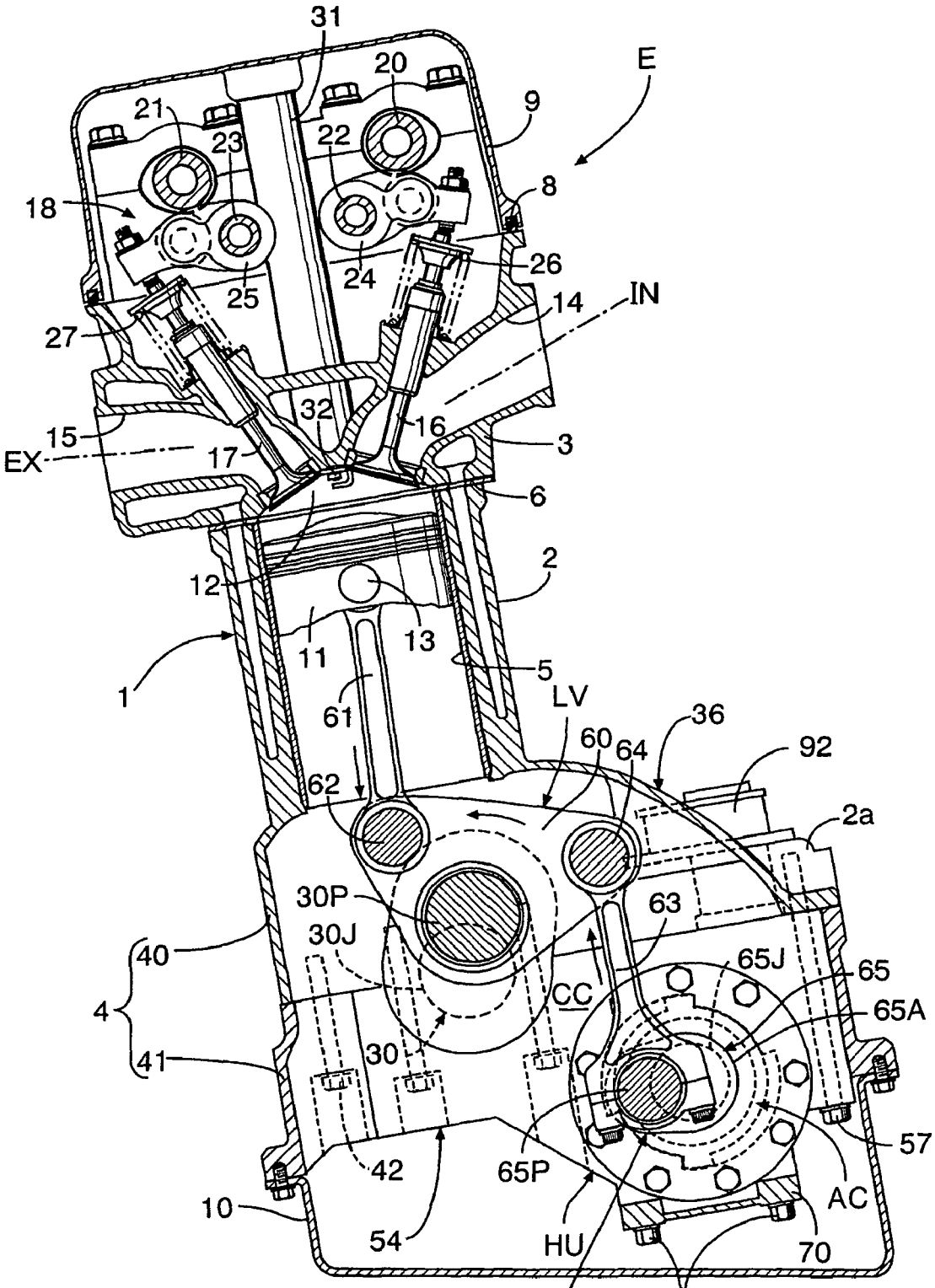
FIG. 4 is a sectional view along line 4-4 in FIG. 1 (low compression ratio state) (first embodiment).

As shown in FIGS. 3 and 4, the crankcase 4, which is formed from the upper block 40 (upper crankcase) on the lower part of the cylinder block 2 and the lower block 41 (lower crankcase), protrudes toward the front (front of the vehicle) relative to the cylinder 5 portion of the cylinder block 2, and a variable stroke link mechanism LV (described later) that makes the stroke travel of the piston 11 variable and a vane type hydraulic actuator AC (described later) driving the variable stroke link mechanism LV are provided within a crank chamber CC of this protruding portion 36.

Figure 8:
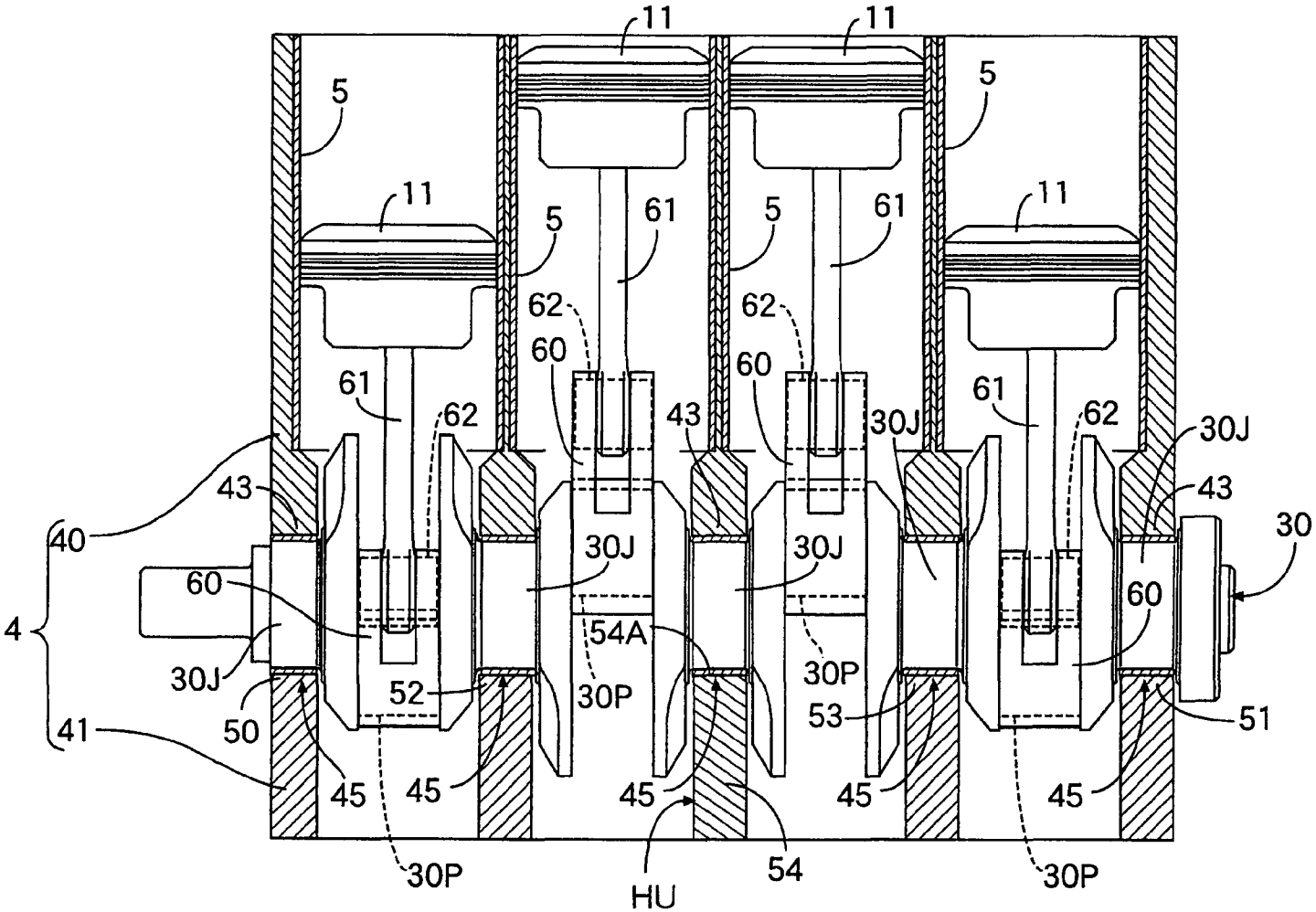
FIG. 8 is a sectional view along line 8-8 in FIG. 3 (first embodiment).

As shown in FIGS. 2 to 5, the lower block 41 is fixed via a plurality of linking bolts 42 to the lower face of the upper block 40, which is integrally formed on a lower part of the cylinder block 2. Journal shafts 30J of the crankshaft 30 are rotatably supported on a plurality of journal bearings 43 formed between mating surfaces of the upper block 40 and the lower block 41 (see FIG. 8).

Figure 5:
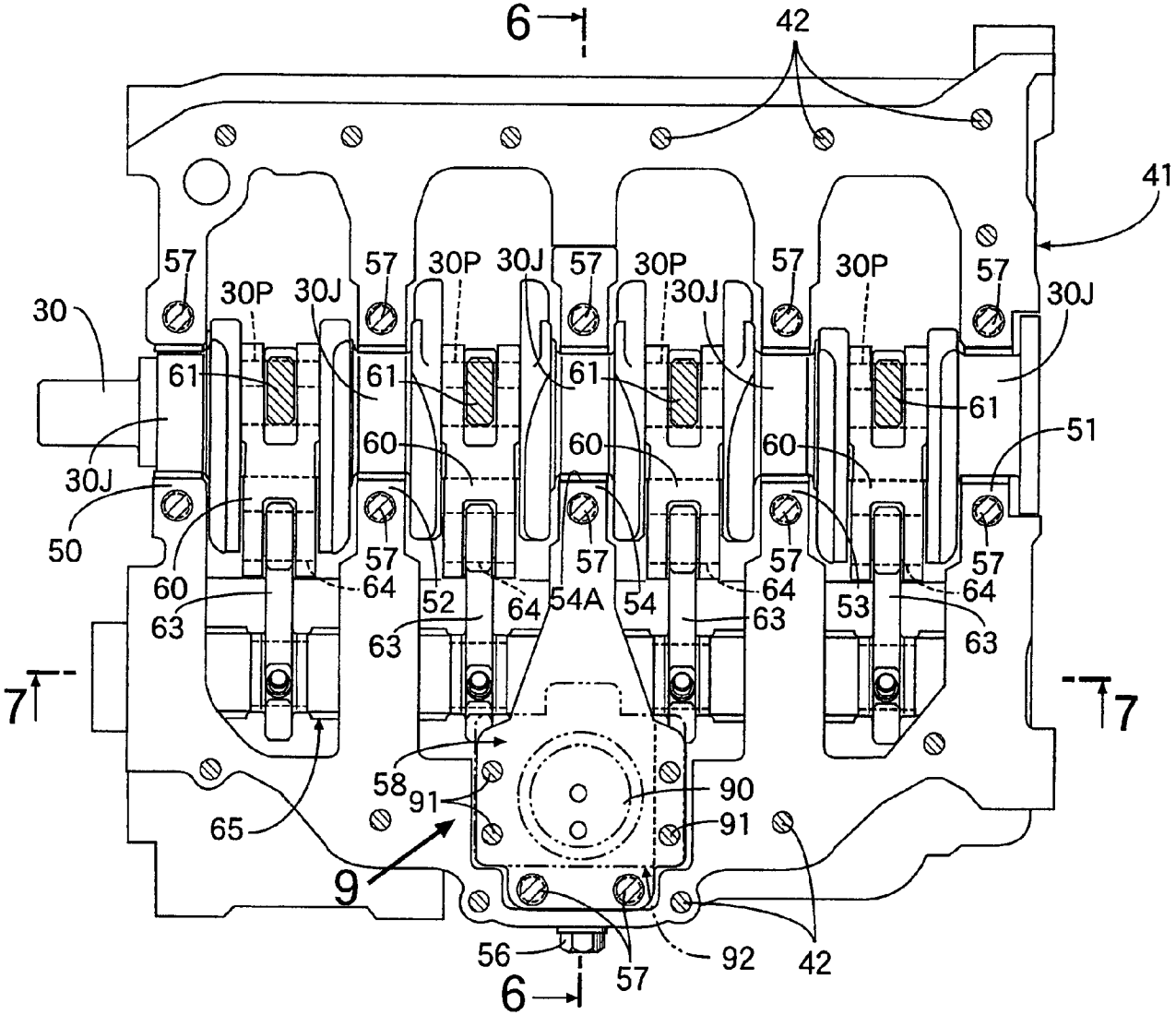
FIG. 5 is a sectional view along line 5-5 in FIG. 2 (first embodiment).

As shown in FIG. 5, the lower block 41 is cast-molded in a structure having a rectangular closed section in plan view; left and right end sections thereof are provided with end section bearing members 50 and 51, a middle section thereof is provided with left and right middle bearing members 52 and 53, and the center thereof is provided with, as a bearing cap, a center bearing member 54 (a housing HU, described later, is integrally molded therewith), and the journal shafts 30J of the crankshaft 30 are supported by these bearing members 50 to 54.

Figure 6:
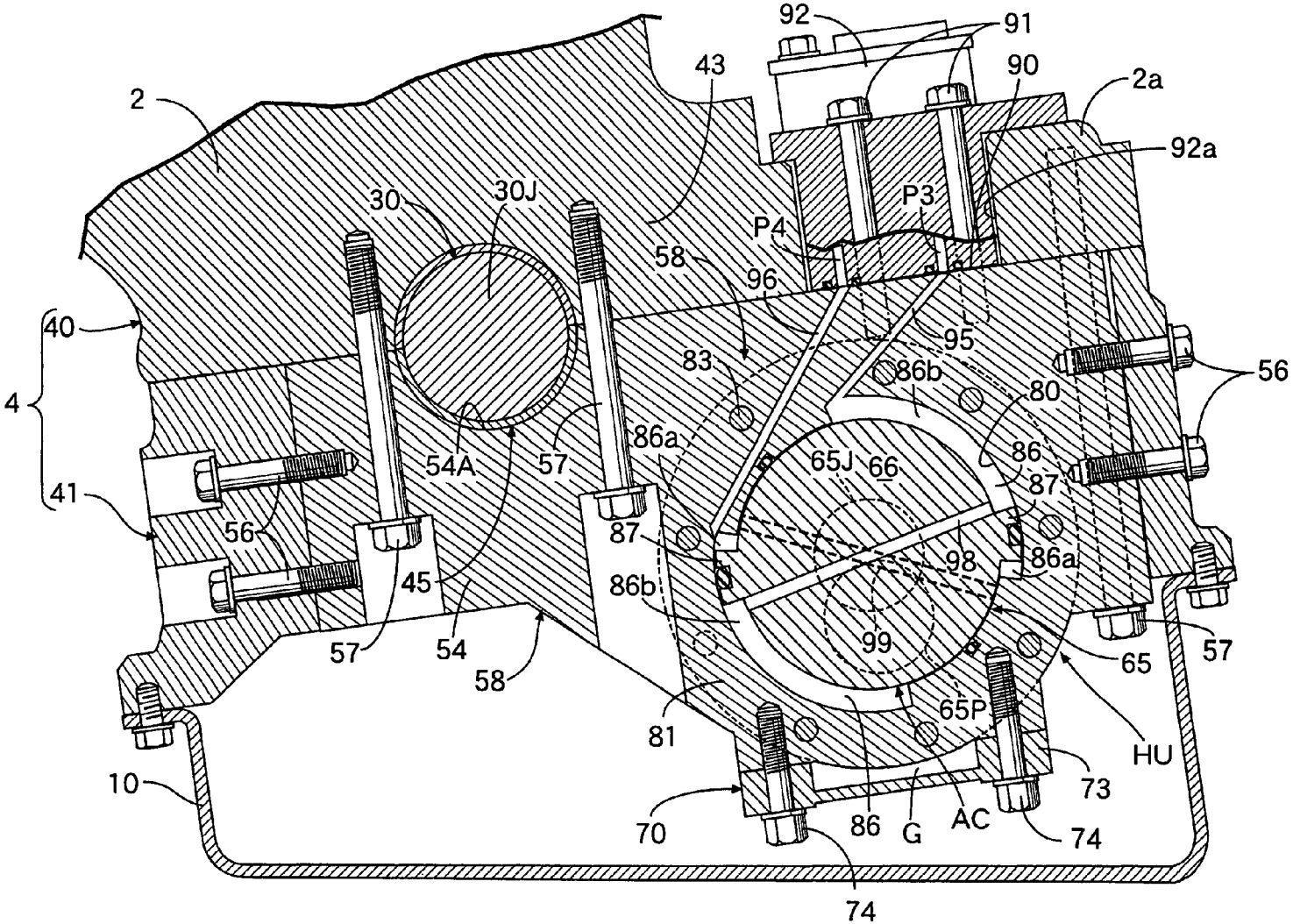
FIG. 6 is a transverse sectional view along line 6-6 in FIG. 5 (first embodiment).
Figure 9:
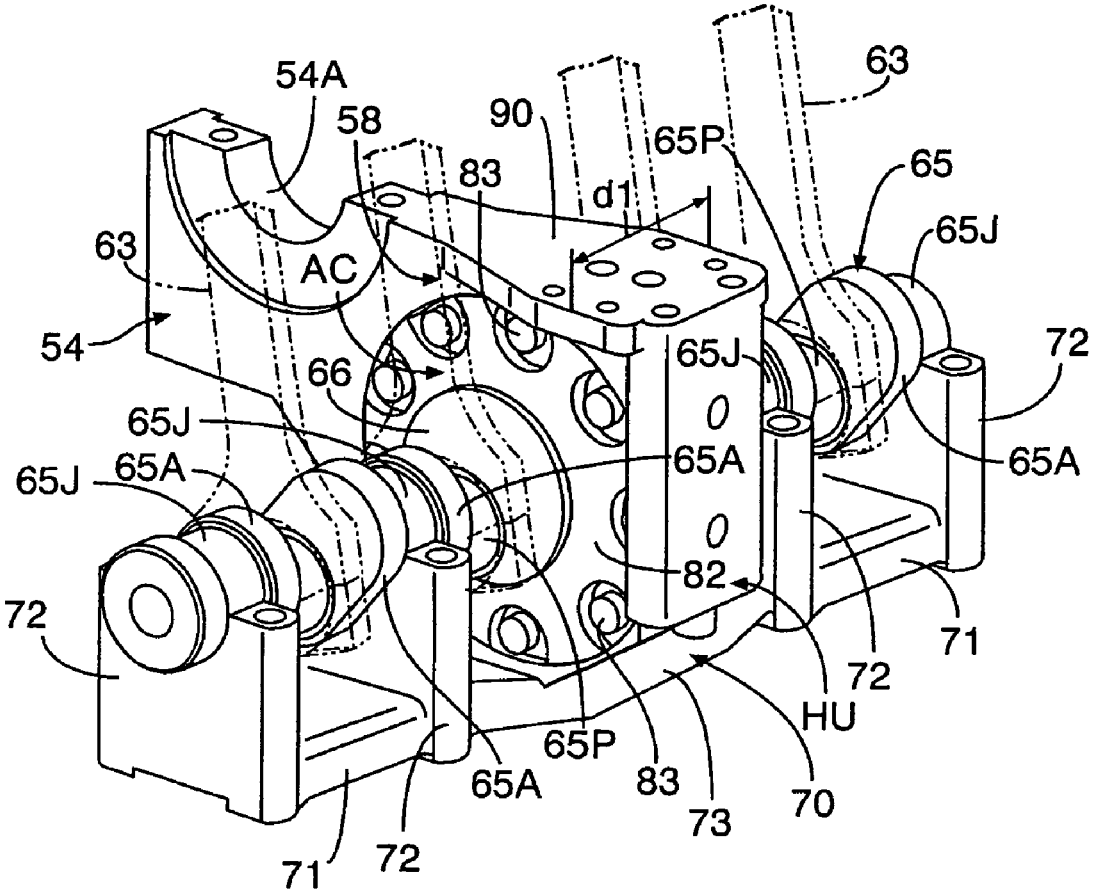
FIG. 9 is a perspective view from arrow 9 in FIG. 5 (first embodiment).
Figure 10:
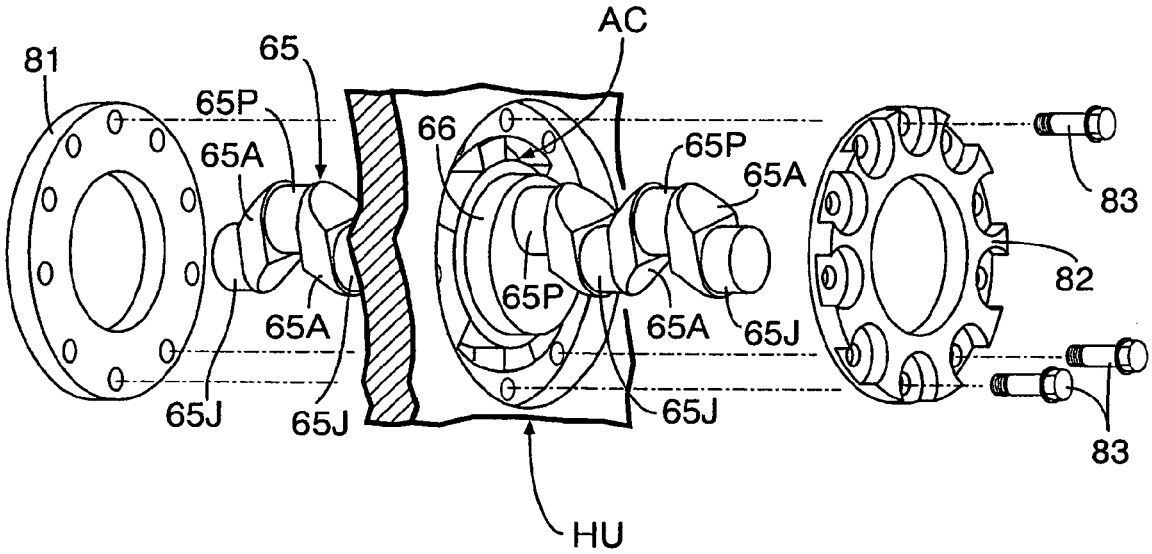
FIG. 10 is an exploded perspective view of an actuator (first embodiment).

As shown in FIGS. 5, 6, and 9, the center bearing member 54 is cast-molded separately from the lower block 41, and is fixed firmly to the lower block 41 via a plurality of linking bolts 56, and this center bearing member 54 is also fixed firmly to the lower face of the upper block 40 via other linking bolts 57. One side of the center bearing member 54, biased toward one side (the front of the engine main body 1) from a bearing portion 54A for the crankshaft 30, is formed as an expanded portion 58 having an extended vertical width and a large thickness, and the housing HU of the vane type hydraulic actuator AC, which will be described in detail later, is cast-molded on this expanded portion 58.

Referring mainly to FIGS. 3 and 4, the structure of the variable stroke link mechanism LV, which makes the stroke travel of the piston 11 variable, is now explained. A middle section of a triangular lower link 60 is swingably and pivotably supported on and linked to each of a plurality of crankpins 30P of the crankshaft 30, which is rotatably supported on mating surfaces of the upper block 40 and the lower block 41. Pivotably supported on and linked to one end (upper end) of the lower link 60 is a lower end (big end) of an upper link (connecting rod) 61 pivotably supported on and linked to a piston pin 13 of the piston 11 via a first linking pin 62, and pivotably supported on and linked to the other end (lower end) of each lower link 60 via a second linking pin 64 is an upper end of a control link 63. This control link 63 extends downwardly, and an eccentric pin 65P of a control shaft 65 (described in detail later), which is formed in a crank shape, is pivotably supported on and linked to a lower end of the control link 63. The control shaft 65 is provided coaxially with the vane type hydraulic actuator AC (described in detail later), the control shaft 65 is pivoted within a predetermined angular range (about 90 degrees) by driving of the vane type hydraulic actuator AC, and this causes the eccentric pin 65P to be displaced in phase, thus swinging the control link 63. Specifically, the control shaft 65 can rotate between a first position (eccentric pin 65P at a lower position) shown in FIG. 3 and a second position (eccentric pin 65P at a leftward position) shown in FIG. 4. In the first position shown in FIG. 3, since the eccentric pin 65P of the control shaft 65 is in the lower position, the control link 63 is pulled down, the lower link 60 swings in a clockwise direction around the crankpin 30P of the crankshaft 30, the upper link 61 is pushed upward, the position of the piston 11 attains a high position relative to the cylinder 5, and the engine E attains a high compression ratio state. Conversely, in the second position shown in FIG. 4, since the eccentric pin 65P of the control shaft 65 is positioned leftward (at a higher position than the first position), the control link 63 is pushed upward, the lower link 60 swings in an anticlockwise direction around the crankpin 30P of the crankshaft 30, the upper link 61 is pushed down, the position of the piston 11 attains a low position relative to the cylinder 5, and the engine E attains a low compression ratio state. As described above, by controlling pivoting of the control shaft 65, the control link 63 swings, conditions for the restriction of movement of the lower link 60 change, the stroke characteristics, such as the position of top dead center of the piston 11 change, and the compression ratio of the engine E can thereby be freely controlled.

The upper link 61, the first linking pin 62, the lower link 60, the second linking pin 64, and the control link 63 form the variable stroke link mechanism LV.

As shown in FIGS. 6, 7, 9, and 10, the control shaft 65, which is linked to the control link 63 and operates the variable stroke link mechanism LV, is formed, in the same way as the crankshaft 30, in a crank shape, in which a plurality of journal shafts 65J and the eccentric pins 65P are alternately joined via arms 65A, a cylindrical vane shaft 66 of the vane type hydraulic actuator AC is coaxially provided integrally with a central section in the axial direction thereof, and the eccentric pins 65P of the control shaft 65 are directly fixed to eccentric positions on each of opposite side faces of the vane shaft 66. The control shaft 65 is provided so as to be biased toward one side of the lower block 41 (the front side of the engine main body 1), and the journal shafts 65J thereof are rotatably supported between the lower block 41 and a bearing block 70 fixed to the lower face thereof by a plurality of linking bolts 68.

Figure 7:
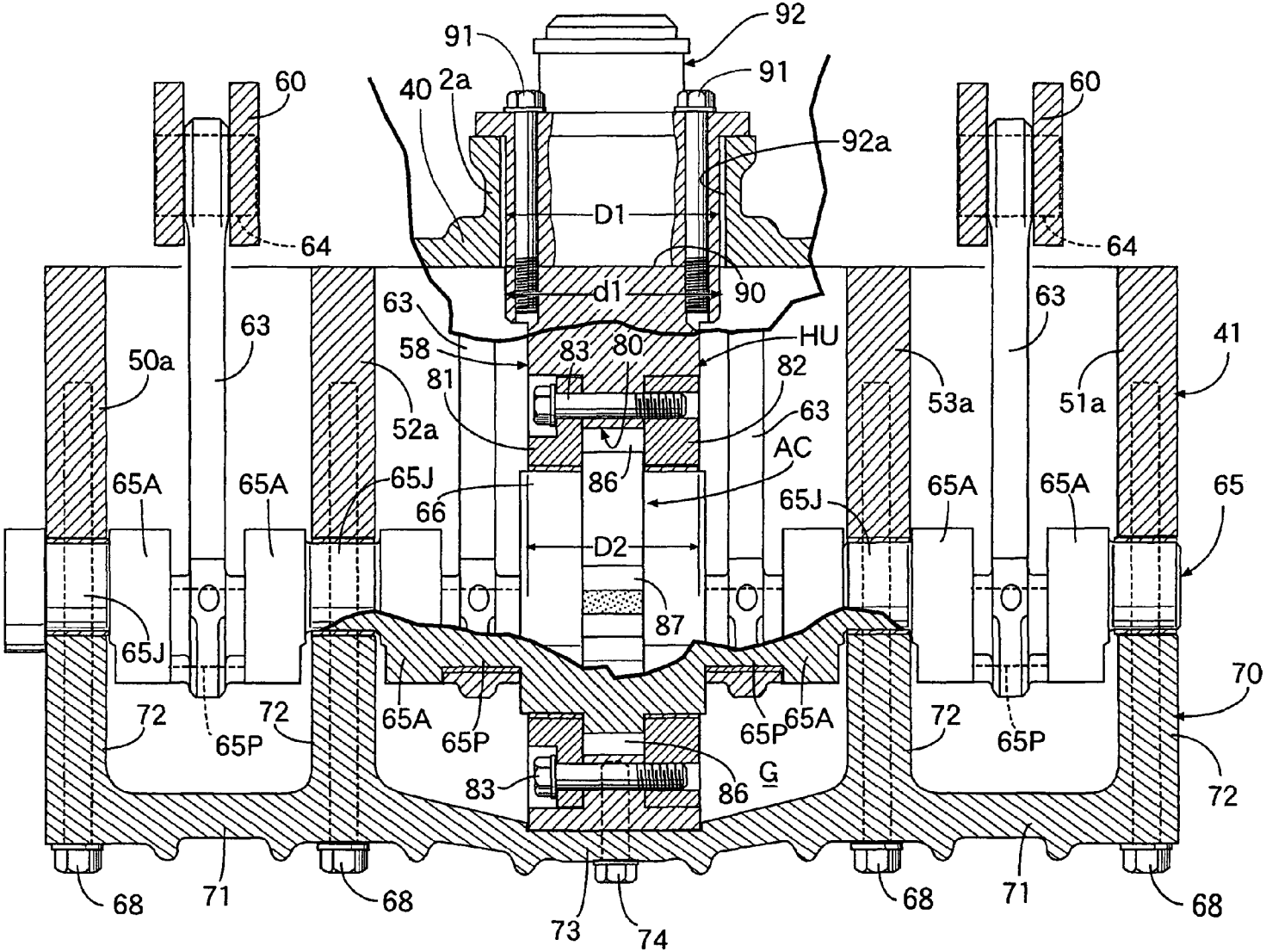
FIG. 7 is an enlarged sectional view along line 7-7 in FIG. 5 (first embodiment).

As shown in FIGS. 6, 7, and 9, the bearing block 70 supporting the control shaft 65 is cast-molded in a block shape with a linking member 71 extending in the axial direction of the control shaft 65, a plurality of bearing walls 72 joined integrally to and rising from the linking member 71 while being spaced in the longitudinal direction thereof, and a central housing receiving part 73 provided in a longitudinally central part of the linking member 71, thereby guaranteeing high rigidity, and as described above the plurality of journal shafts 65J of the control shaft 65 are rotatably supported by bearings formed on mating surfaces of an upper face of the plurality of bearing walls 72 and a lower face of bearing walls 50*a*, 51*a*, 52*a*, and 53*a* extended from the bearing members 50, 51, 52, and 53 of the lower block 40. Furthermore, as shown in FIG. 7, the central housing receiving part 73 is formed in a downwardly concave shape in a direction away from the housing HU, a recess G is formed thereabove, a lower part of the housing HU of the vane type hydraulic actuator AC is housed in the recess G, and the lower part of the housing HU is secured onto the central housing receiving part 73 via a plurality of securing bolts 74. Therefore, the housing HU of the hydraulic actuator AC is integrally secured to and supported on the bearing block 70 supporting the control shaft 65.

Since the housing HU of the actuator AC is integrally secured to the bearing block 70, which has high rigidity, the rigidity of the housing HU itself is increased and, furthermore, since the recess G is formed in the central housing receiving part 73 of the bearing block 70, and the lower part of the housing HU is housed in this recess G as a housing space, the actuator AC can be mounted compactly on the engine main body 1 of the engine E with high rigidity, thereby contributing to a reduction in the dimensions of the engine E itself.

The vane type hydraulic actuator AC provided coaxially with the control shaft 65 is provided within the crank chamber CC of the engine main body 1, and the housing HU housing and supporting a hydraulic drive section thereof is provided in the expanded portion 58 on one side part of the center bearing member 54 (fixed integrally to the upper block 40 and the lower block 41) as the bearing cap. A short cylindrical vane chamber 80 with opposite end faces opened is formed in an axially central part of the housing HU. The vane shaft 66, which is integral with the control shaft 65, is housed within this vane chamber 80, and a pair of vanes 87 are formed integrally with an axially central part on the outer periphery of the vane shaft 66 with a phase difference of about 180°. Furthermore, axially left and right opposite side parts (having a slightly smaller diameter than that of the central part) of the vane shaft 66 are rotatably supported, via surface bearings, on left and right vane bearings 81 and 82, which become another housing, fixed via a plurality of bolts 83 to opposite side parts of the housing HU. The opened side faces of the housing HU are closed by the vane bearings 81 and 82. As shown in FIG. 6, between an inner peripheral face of the vane chamber 80 and an outer peripheral face of the vane shaft 66, a pair of fan-shaped vane oil chambers 86 are defined with a phase difference of about 180°, the pair of vanes 87 projectingly provided integrally with the outer peripheral face of the vane shaft 66 are housed within the vane oil chambers 86, outer peripheral faces of the vanes 87 are in sliding contact with the inner peripheral face of the vane oil chambers 86 via a gasket, and each vane 87 oil-tightly divides the interior of the fan-shaped vane oil chamber 86 into two control oil chambers 86*a*, 86*b*.

As shown in FIG. 6, two communication oil paths 98 and 99 are bored in the vane shaft 66 in a crossed state on diameter lines while being spaced in the axial direction; one communication oil path 98 provides communication between the pair of control oil chambers 86*b*, and the other communication oil path 99 provides communication between the pair of control oil chambers 86*a*.

In addition, the housing HU of the vane type hydraulic actuator AC, which drives the control shaft 65, can be made compact and formed with a small number of components using the center bearing member of the lower block 41 as the bearing cap (formed separately from the lower block 41 and fixed thereto), and the volume of the housing HU occupying the interior of the crank chamber CC can be made small, thus suppressing any increase in the bulk of the crankcase.

As shown in FIGS. 5, 7, and 9, a flat mounting face 90 is formed so as to widen in a dovetail shape from the bearing 54A for the crankshaft 30 toward an end part of the housing HU side on an upper face of the housing HU formed in the center bearing member 54 as a bearing cap, a width d1 in the control shaft 65 direction of the mounting face 90 is made wider than a width D2 of the housing HU in the same direction, the mounting face 90 is exposed outside the engine main body 1, the hydraulic switching valve unit 92, which houses a solenoid valve V (FIG. 11) of the hydraulic control circuit, is seated on the mounting face 90 from outside the engine main body 1, and the hydraulic switching valve unit 92 is clamped together to the cylinder block 2 and the center bearing member 54 as a bearing cap via a plurality of clamping bolts 91. That is, as shown in FIG. 6, a mounting hole 92*a* is bored so as to run vertically through an extended wall 2*a* extending forward substantially horizontally from a lower part of the cylinder block 2, the hydraulic switching valve unit 92 is inserted into the mounting hole 92*a*, and a lower face of the hydraulic switching valve unit 92 is seated on the mounting face 90 of the housing HU via a gasket. Inserting the plurality of clamping bolts 91 into the hydraulic switching valve unit 92 from above and screwing and tightening them into the housing HU integrally clamps together the three components, that is, the hydraulic switching valve unit 92, the cylinder block 2, and the center bearing member 54 as bearing means for the crankshaft 30 via the plurality of clamping bolts 91.

Since the hydraulic switching valve unit 92 is mounted on the housing HU of the hydraulic actuator AC, it is unnecessary to employ piping providing communication therebetween, the responsiveness of the hydraulic actuator AC can be improved and, moreover, high reliability can be guaranteed, thus contributing to a simplification of the structure. Moreover, since the hydraulic switching valve unit 92 is clamped together with the cylinder block 2 and the bearing means for the crankshaft 30 (the center bearing member 54 as a bearing cap), the rigidity with which the valve unit 92 is secured can be enhanced. Furthermore, since the hydraulic switching valve unit 92 can be mounted on the mounting face 90 of the housing HU of the hydraulic actuator AC and on the front side of the vehicle, the ease of detaching the hydraulic switching valve unit 92 can be improved. Furthermore, since the mounting face 90 has a dovetail shape with a larger width than that of the housing HU, the rigidity with which the hydraulic switching valve unit 92 is mounted can be improved.

The hydraulic switching valve unit 92 may be clamped together with the cylinder block 2 and the lower block 41 as bearing means for the crankshaft 30 by means of the plurality of clamping bolts 91.

As shown in FIG. 7, the width D2, in the control shaft 65 direction, of the housing HU of the hydraulic actuator AC is narrower than a width D1, in the same direction, of the hydraulic switching valve unit 92 and, moreover, is contained within the width D1, and the housing HU is made compact while enhancing the rigidity with which it is mounted on the hydraulic switching valve unit 92.

In addition, the center bearing member 54 as a bearing cap or the lower block 41 of this embodiment forms bearing means for the crankshaft 30 related to the present invention.

In accordance with the above, as shown in FIG. 1, since the hydraulic switching valve unit 92 is disposed in an exposed state on the extended wall 2*a* of the cylinder block 2, which extends substantially horizontally, and is open in four directions, it is easy to carry out a switching operation, maintenance, etc. of the valve unit 92. Furthermore, since the hydraulic switching valve unit 92 is provided on the front side of the engine main body 1, that is, the side to which the intake system is connected, it is possible to suppress the influence of heat from a heat source of an engine compartment, particularly an exhaust system. Moreover, since the hydraulic switching valve unit 92 is disposed within the plane of projection of the opening of the radiator fan RF when viewed from the front of the vehicle, and it receives wind flow and air flow from the radiator fan RF, any increase in the temperature thereof can be suppressed.

Figure 11:
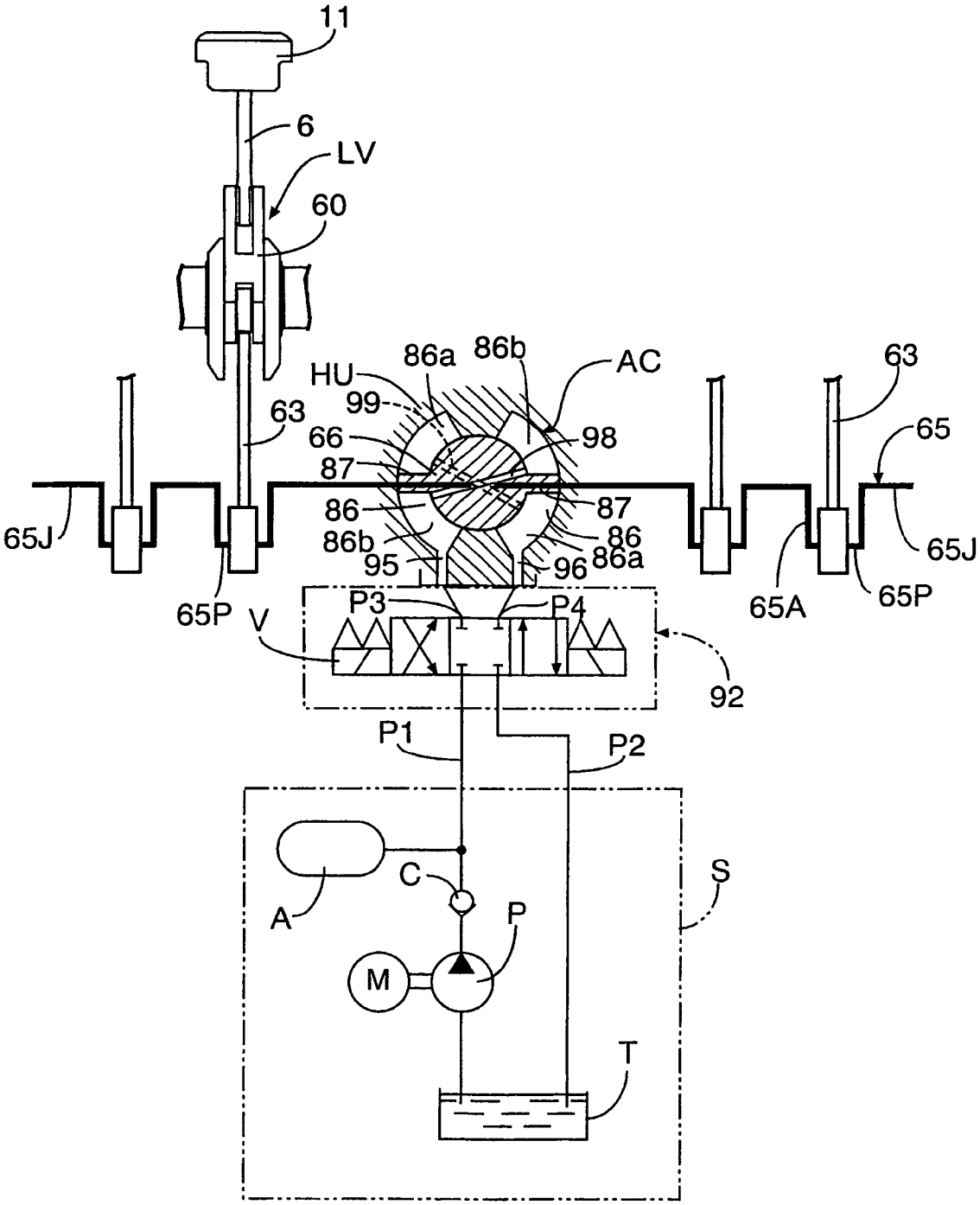
FIG. 11 is a hydraulic circuit diagram of a control system of the actuator (first embodiment).

The hydraulic circuit of the vane type hydraulic actuator AC for driving and controlling the variable stroke link mechanism LV is now explained by reference to FIG. 11.

As described above, the interior of the pair of fan-shaped vane oil chambers 86 formed by the vane shaft 66 of the control shaft 65 and the housing HU is divided into the two control oil chambers 86*a* and 86*b* by the vane 87, and these control oil chambers 86*a* and 86*b* are connected to an oil tank T via the hydraulic circuit, which is described below. Connected to the hydraulic circuit are an oil pump P driven by a motor M, a check valve C, an accumulator A, and the solenoid switching valve V. The oil tank T, the motor M, the oil pump P, the check valve C, and the accumulator A form a hydraulic supply system S, and are provided at an appropriate location on the engine main body 1, and the solenoid switching valve V is provided in the interior of the valve unit 92. The hydraulic supply system S and the solenoid switching valve V are connected by two pipelines P1 and P2, and two ports P3 and P4 of the solenoid switching valve V and the control oil chambers 86*a* and 86*b* of the vane type hydraulic actuator AC are connected directly without requiring piping. Therefore, in FIG. 11, when the solenoid switching valve V is switched to a right position, hydraulic oil generated by the oil pump P is supplied to the control oil chamber 86*b*, the oil pressure pushes the vane 87, and the control shaft 65 rotates in a clockwise direction, whereas when the solenoid switching valve V is switched to a left position, the hydraulic oil generated by the oil pump P is supplied to the control oil chamber 86*a*, the oil pressure pushes the vane 87, and the control shaft 65 rotates in an anticlockwise direction; by so doing, the phase of the eccentric pin 65P of the control shaft 65 changes. As described above, the control link 63 of the variable stroke link mechanism LV is swingably and pivotably supported on and linked to the eccentric pin 65P of the control shaft 65, and by driving the control shaft 65 (through about) 90°, the variable stroke link mechanism LV is operated by the change in phase of the eccentric pin 65P of the control shaft 65.

In accordance with this embodiment, since the housing HU of the hydraulic actuator AC for operating the variable stroke link mechanism LV is provided in the center bearing member 54, as a bearing cap, for the crankshaft 30, the center bearing member 54 being part of the engine main body 1, compared with a conventional housing provided separately and independently from an engine main body, it is possible to make it compact with a smaller number of components and, even if the housing HU is provided within the crank chamber CC, the volume of the crank chamber CC does not increase, and any increase in the dimensions of the engine E can be suppressed. Moreover, particularly since the housing HU of the hydraulic actuator AC is provided in the center bearing member 54, which is a bearing cap for the crankshaft 30, it is possible to position the actuator AC in proximity to the crankshaft 30, further reduce the dimensions of the engine E, and enhance the rigidity with which the crankshaft 30 is supported.

Furthermore, when portions, other than the housing HU, of the center bearing member 54 as a bearing cap are formed from aluminum alloy, and the housing HU of the actuator AC forming the vane chamber 80 is formed from iron, which has higher rigidity than the aluminum alloy, casting the housing HU on the bearing cap 54 enables a good balance between rigidity and light weight of the housing HU to be achieved. In this case, the rigidity becomes high compared with a case in which the whole of the bearing cap 54 is made of an aluminum alloy, and the weight can be reduced compared with a case in which the whole of the bearing cap is made of iron.

Furthermore, since, among the plurality of bearing members 50 to 54 supporting the crankshaft 30, the housing HU of the actuator AC is provided in the center bearing member 54 while avoiding the bearing members 50 and 51 at opposite ends, it contributes to a further reduction in the dimensions of the engine.

Moreover, since the housing HU of the actuator AC is provided in the center bearing member 54 of the engine main body 1 of the in-line four cylinder engine E, it is possible to contribute to improving still further the rigidity of the center bearing member 54, on which the largest load is imposed.

Furthermore, since the housing HU of the actuator AC is formed separately from the lower block 41 fixed to the upper block 40 of the cylinder block 2, this gives a degree of freedom in selecting the material for the housing HU, the degree of freedom in machining it as a single component increases, and the assembly thereof onto the lower block 41 can be carried out compactly and easily.

Moreover, since the hydraulic switching valve unit 92 for controlling the supply of hydraulic oil to the hydraulic actuator AC is mounted on the housing HU of the hydraulic actuator AC, the hydraulic switching valve unit 92 can be connected to the hydraulic actuator AC in close proximity without requiring piping, thus improving the responsiveness of the hydraulic actuator AC. Furthermore, since the hydraulic switching valve unit 92 is clamped together with the cylinder block 2 of the engine main body 1 and the bearing means, it is possible to improve the rigidity with which the valve unit 92 is secured and reduce the number of components. Moreover, since the width d1, in the control shaft direction, of the mounting face 90, for the hydraulic switching valve unit 92, of the housing HU of the hydraulic actuator AC is formed so as to be wider than the width D2 in the control shaft direction of the housing HU, it is possible to guarantee the rigidity of the mounting face 90 of the housing HU without increasing the overall dimensions of the housing HU. Furthermore, since the width D2 in the control shaft direction of the housing HU of the hydraulic actuator AC is formed so as to be narrower than the width D1 in the control shaft direction of the hydraulic switching valve unit 92 and is contained within the width D2, the housing AC can be made compact while improving the rigidity with which the hydraulic switching valve unit 92 is supported.

Moreover, since the hydraulic switching valve unit 92 is provided on the side to which the intake system IN of the engine main body 1 is connected, it is possible to suppress the influence of heat from a heat source, in particular the exhaust system; furthermore, since the hydraulic switching valve unit 92 receives wind flow and air flow from the radiator fan, any increase in the temperature thereof can be suppressed and, moreover, since the hydraulic switching valve unit 92 can be mounted on the housing HU of the hydraulic actuator AC from outside the engine main body 1, the ease of mounting greatly improves.

An embodiment of the present invention is explained above, but the present invention is not limited to this embodiment, and various embodiments are possible within the scope of the present invention.

For example, in the embodiment above, the present invention is explained for a case in which it is applied to a variable compression ratio engine in which the top dead center of the piston is changed by changing the phase of the eccentric pin of the control shaft, but it can be applied to other variable stroke characteristic engines, for example, an arrangement in which, by controlling continuous rotation of a control shaft at a rotational speed of ½ that of a crankshaft by means of an actuator, the position of a piston at each of intake, compression, combustion, and exhaust strokes, and the stroke length are made variable.

Furthermore, in the above-mentioned embodiment, a case in which a vane type hydraulic actuator is used as an actuator is explained, but another actuator such as an electric actuator may be used instead, and in the embodiment the hydraulic switching valve unit is clamped together with the cylinder head and the center bearing member as the bearing cap, but it may be clamped together with the cylinder head to the lower block. Moreover, in the embodiment the bearing cap provided on the housing is formed separately from the lower block, but the bearing cap provided on the housing may be formed integrally with the lower block.

The invention claimed is:

1. A variable stroke characteristic engine in which a piston (11) and a crankshaft (30) are linked to a control shaft (65) via a variable stroke link mechanism (LV), and the variable stroke link mechanism (LV) is operated by an actuator (AC) that drives the control shaft (65) to thus make the stroke travel of the piston (11) variable, characterized in that at least part of a housing (HU) of the actuator (AC) is formed as part of an engine main body (1), and said part of the engine main body (1) forming at least part of the housing (HU) of the actuator (AC) is a bearing member (54) that is fixed to the engine main body (1) and rotatably supports the crankshaft (30).

2. The variable stroke characteristic engine according to claim 1, wherein the bearing member (54) is a bearing cap that is fixed to a cylinder block (2) forming the engine main body (1) and rotatably supports the crankshaft (30).

3. The variable stroke characteristic engine according to claim 1, wherein at least part of the housing (HU) of the actuator (AC) is cast on the bearing member (54).

4. The variable stroke characteristic engine according to claim 1, wherein, among a plurality of bearing members (50 to 54) supporting the crankshaft (30), the housing (HU) of the actuator (AC) is provided in a bearing member (54) while avoiding bearing members (50, 51) at opposite ends.

5. The variable stroke characteristic engine according to claim 4, wherein the housing (HU) of the actuator (AC) is provided in a center bearing member (54) of the engine main body (1) of an in-line four cylinder engine.

6. The variable stroke characteristic engine according to claim 1, wherein the housing (HU) of the actuator (AC) is formed separately from a lower block (41) fixed to an upper block (40) of the cylinder block (2).

7. The variable stroke characteristic engine according to claim 1, wherein the actuator (AC) is a hydraulic actuator, and a hydraulic switching valve unit (92) for controlling the supply of hydraulic oil thereto is mounted on the housing (HU) of the hydraulic actuator (AC).

8. The variable stroke characteristic engine according to claim 7, wherein the hydraulic switching valve unit (92) is clamped together with a cylinder block (2) of the engine main body (1) and bearing means (41; 54) fixed to the cylinder block (2) so as to support the crankshaft (30).

9. The variable stroke characteristic engine according to claim 7, wherein a width (d1), in the control shaft (65) direction, of a mounting face (90), for the hydraulic switching valve unit (92), of the housing (HU) of the hydraulic actuator (AC) is formed so as to be wider than a width (D2) of the housing (HU) in the control shaft (65) direction.

10. The variable stroke characteristic engine according to claim 7, wherein the width (D2) of the housing (HU) of the hydraulic actuator (AC) in the control shaft (65) direction is formed so as to be narrower than a width (D1) of the hydraulic switching valve unit (92) in the control shaft (65) direction, and is contained within the width (D1).

11. The variable stroke characteristic engine according to claim 7, wherein the hydraulic switching valve unit (92) is provided on the engine main body (1) on a side to which an intake system (IN) is connected.

12. The variable stroke characteristic engine according to claim 7, wherein the hydraulic switching valve unit (92) is disposed within a plane of projection of an opening of a radiator fan (RF) when viewed from the front side of a vehicle.

13. The variable stroke characteristic engine according to claim 7, wherein the housing (HU) of the hydraulic actuator (AC) is disposed within a crankcase (4), and the hydraulic switching valve unit (92) is mounted on a portion of the housing (HU) of the hydraulic actuator (AC) that is exposed outside the engine main body (1).

* * * * *

UNITED STATES PATENT AND TRADEMARK OFFICE

CERTIFICATE OF CORRECTION

PATENT NO. : 8,015,955 B2
APPLICATION NO. : 12/439779
DATED : September 13, 2011
INVENTOR(S) : Akinori Maezuru et al.

It is certified that error appears in the above-identified patent and that said Letters Patent is hereby corrected as shown below:

On the Title Pg, in the title and at column 1, item No. (54), after "VARIABLE STROKE" insert --CHARACTERISTIC ENGINE--.

Signed and Sealed this
Thirteenth Day of December, 2011

David J. Kappos

David J. Kappos
*Director of the United States Patent and Trademark Office*